US005957673A

United States Patent [19]

Kampichler et al.

[11] Patent Number: 5,957,673

[45] Date of Patent: Sep. 28, 1999

[54] INJECTION PUMP FOR DIESEL ENGINES

[75] Inventors: Gunter Kampichler; Herbert Geier, both of Ruhstorf, Germany

[73] Assignee: Motorenfabrik Hatz GmbH & Co. KG., Ruhstorf Roff, Germany

[21] Appl. No.: 08/519,605

[22] Filed: Aug. 25, 1995

Related U.S. Application Data

[63] Continuation of application No. PCT/EP94/00746, Oct. 3, 1994.

[30] Foreign Application Priority Data

Nov. 3, 1993 [DE] Germany ..... P 43 07 699

[51] Int. Cl.[6] ..... F02M 37/04

[52] U.S. Cl. ..... 417/437; 123/508

[58] Field of Search ..... 417/364, 437, 417/499, 360, 500; 92/140; 123/508, 509, 507

[56] References Cited

U.S. PATENT DOCUMENTS

| | | | |
|---|---|---|---|
| 1,451,228 | 4/1923 | Larson | 123/294 |
| 1,521,267 | 12/1924 | Andrews | 184/27.1 |
| 1,901,835 | 3/1933 | Thomas | 417/428 |
| 2,424,943 | 7/1947 | Nicolls | 417/387 |
| 4,234,292 | 11/1980 | Berg | 417/214 |
| 4,535,641 | 8/1985 | Kriz et al. | 74/53 |
| 5,174,734 | 12/1992 | Thomas et al. | 417/490 |
| 5,540,207 | 7/1996 | Absenger | 123/508 |

FOREIGN PATENT DOCUMENTS

| | | | |
|---|---|---|---|
| 680499 | 5/1930 | France | 123/508 |
| 38321 | 9/1925 | Sweden | 123/507 |
| 70985 | 3/1926 | Sweden | 123/508 |
| WO 94/20747 | 9/1994 | WIPO | 123/507 |
| WO 94/20748 | 9/1994 | WIPO | 123/507 |
| WO 94/24421 | 10/1994 | WIPO | 123/508 |

*Primary Examiner*—Timothy Thorpe
*Assistant Examiner*—Peter G. Korytnyk
*Attorney, Agent, or Firm*—Helfgott & Karas, P.C.

[57] ABSTRACT

An injection pump for a diesel engine has a pump cylinder with a pump piston slideably mounted therein. The piston has a broadened foot portion. A cam is mounted on the camshaft and a rocker arm is mounted on a pivoting axis and has a camshaft end and a pump-side end. Means are provided for holding the camshaft end of the rocker arm in substantial contact with the cam. The pump-side end of the rocker arm has contact means for contacting the piston and moving the piston in the cylinder as the rocker arm is pivoted. The contact means includes means for loosely coupling the pump-side end of the rocker arm to the foot portion of the piston.

8 Claims, 2 Drawing Sheets

INJECTION PUMP FOR DIESEL ENGINES

This application is a continuation of co-pending International patent Application No. PCT/EP94/00746 filed Oct. 3, 1994.

The invention relates to an injection pump for a diesel engine with a pump piston, which is guided in the pump cylinder, has a broadened foot and is operated by means of a spring-loaded rocker arm driven by the camshaft.

BACKGROUND OF THE INVENTION

In the case of known injection pumps such as that described in EP-A-0 027 441 having a camshaft drive, a linear roller tappet is provided between the piston of the pump and an actuating cam. The roller tappet is guided by means of a guide bushing and works against a compression spring, so that is maintains constant contact with the actuating cam. The pump piston, axially aligned with the guide bushing, is guided linearly in a pump cylinder. The linear guidance of the roller tappet is intended to avoid most of the lateral pressures on the pump piston. However, in practice, there is usually a certain amount of center offset between the linear guidance of the pump piston and that of the roller tappet. In addition, it is not possible to avoid slight lateral forces from acting on the pump piston, if for no other reason than that the linear guidance of the roller tappet also unavoidably has free motion.

In the case of the known injection pumps of the aforementioned type, it is also a disadvantage that they have relatively large external dimensions. Accordingly, they cannot be used for all installations, particularly where available space is a factor.

Furthermore, an injection pump is known from U.S. Pat. No. 1,451,228, in which the outer end of the piston of the pump is broadened by means of a screw-on head, on which an auxiliary roller acts. The auxiliary roller is mounted at the end of a rocker arm. Thus, the auxiliary roller makes reliable contact and the piston of the pump is held against it with a compression spring.

With such an injection pump having no separate roller tappet with linear guidance, appreciable transverse forces act on the piston of the pump, which therefore requires a particularly long cylinder guidance.

Also known is a driving mechanism for an injection pump, CH-A-348 289 in which a 3-arm rocker arm produces a positive connection between the camshaft and the piston of the pump. In the case of such an embodiment, for which the rocker arm works without spring loading, the interacting parts must be produced with the highest precision in the region of their contacting areas. As a result, manufacturing costs are particularly high. In addition, conventional types or engine construction do not permit the injection pump to be disposed directly on the camshaft.

SUMMARY OF THE INVENTION

With this as background, it is an object of the present invention, for an injection pump of the type named above, to avoid the large transverse forces acting on the piston of the pump and, at the same time, to simplify and thus reduce the cost of the construction of the piston guidance of the injection pump.

It is a further object of the present invention to provide an injection pump of the above-mentioned type, which is simpler and therefore less expensive. Another object of the present invention is to reduce the number of individual components of such pump as much as possible and, moreover, to decrease the overall size.

Pursuant to the present invention, these objects may be accomplished by providing such an injection pump wherein the pump-side end of the rocker arm interacts directly with the foot area of the pump piston and wherein the end of the rocker arm is formed by an auxiliary roller operating piston of the pump, the foot and the auxiliary roller being loosely connected on one another by a catch.

With such an injection pump, constricted according to the principles of the present invention, there is no tappet drive for the piston of the pump and no associated linear guide nor the usual piston spring. Instead of an expensive and voluminous pump housing, there is now only the pump cylinder with the associated valve support. The entire pump component is now located in an appropriate borehole of the crankcase and is driven there by means of a rocker arm operated directly by the camshaft. Moreover, the camshaft end of the rocker arm is supported by a contacting spring, so that the rocker arm is always in contact with the actuating cam of the camshaft. The pump-side end of the rocker arm is loosely coupled by means of a catch with the foot end of the pump piston. Accordingly, there is no driving tappet for the pump piston and no group of components associated with the driving tappet such as the piston spring, guide bushing and the part of the housing surrounding these members.

Experiments have shown that a piston pump, which is reduced to a few components in accordance with the present invention, having a pump piston coupled by means of a catch, and driven directly by a rocker arm, fully meets all the requirements particularly those relating to small diesel engines.

A preferred embodiment of the present invention includes an auxiliary roller operating the piston of the pump and is provided at the pump-side end of the rocker arm. This auxiliary roller may preferably include an outer roller and an inner roller, which are tightly fitted coaxially inside on another so that any clearance between these rollers may be taken care of by a film of oil in the space between the rollers. By these means, the advantageous linear contact of the foot surface of the piston of the pump and the auxiliary roller can be maintained during the operation of the piston pump.

A further feature of the present invention is the catch used for loosely coupling the rocker arm to the foot of the pump is fastened pivotally to the end of the rocker arm for installation purposes and, in the final installed position, grips behind a broadened foot of the piston of the pump with a baffle sheet in such manner, that the piston foot is accommodated between the baffle sheet and the auxiliary roller. In order to avoid friction and secondary bending, the foot is accommodated between the baffle sheet and the auxiliary roller with very little clearance.

Another feature of the present invention is that the foot of the piston of the pump is constructed without the central projection customarily provided as a stop face and is replaced by corresponding broadening of the foot area (so called pressure sun), as a result of which an advantageous linear contact with the auxiliary roller is achieved.

BRIEF DESCRIPTION OF THE DRAWINGS

The invention will be more clearly understood by reference to the following detailed description of an exemplary embodiment thereof in connection with the accompanying drawings, in which.

Figure 1:
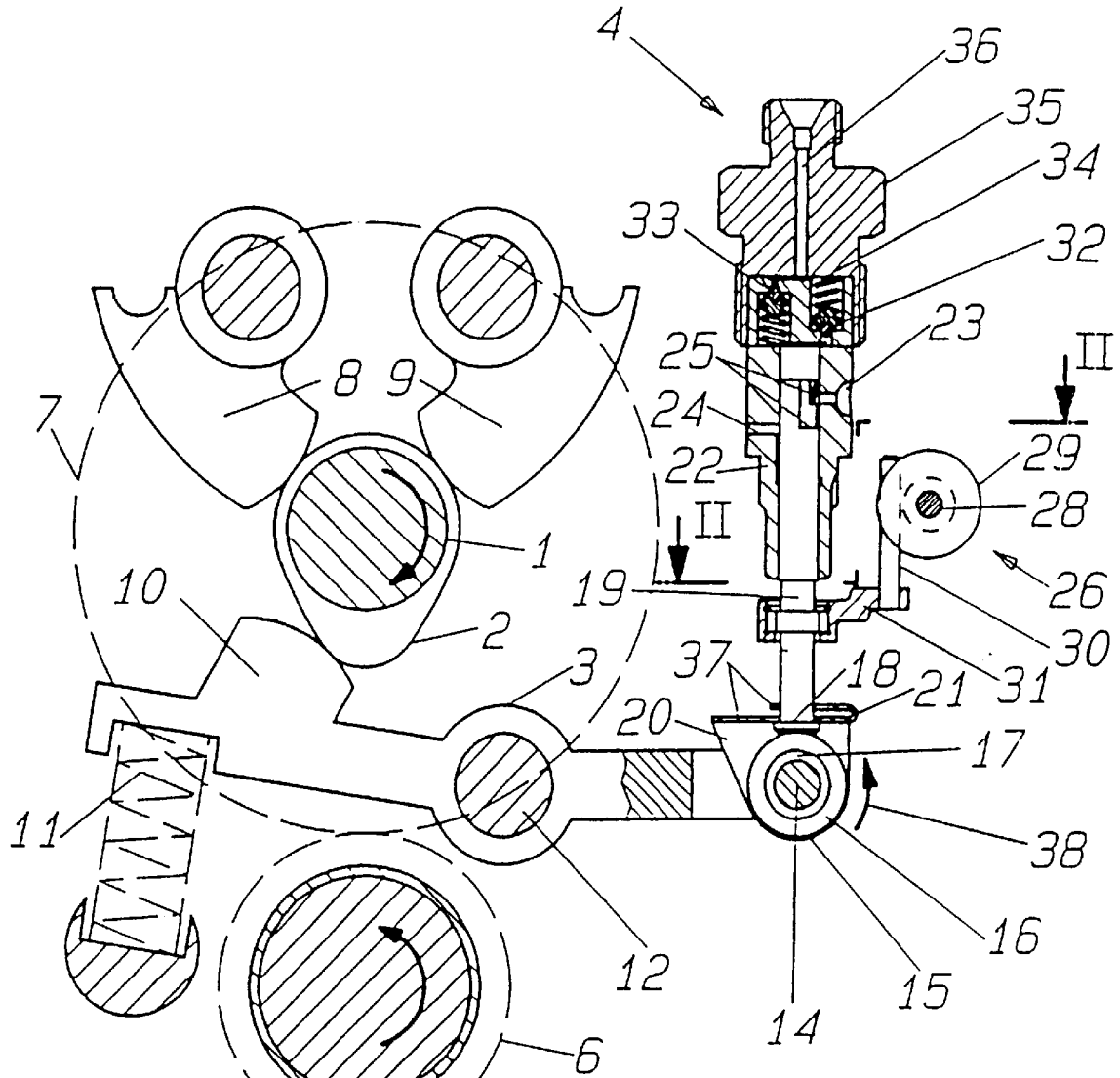
FIG. 1 is a diagrammatic representation partially in section, of a camshaft of an injection pump constructed in accordance with a preferred embodiment of the present invention.

Referring to the drawings and more particularly to FIG. 1, a rocker arm 3 for driving an injection pump 4 cooperates with a camshaft 1 of the diesel engine. The camshaft 1 has a cam 2 mounted thereon.

Figure 2:
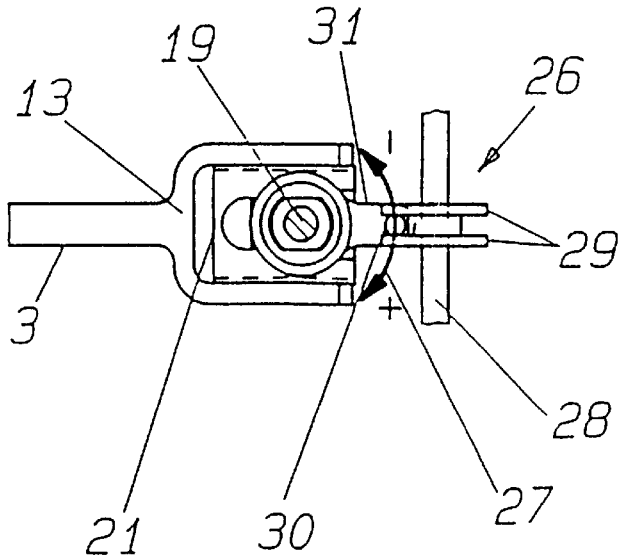
FIG. 2 is a sectional view taken along the lines II—II of FIG. I.

A crankshaft 5 is provided with a pinion gear 6 drawn in dashed lines, which engages with geared teeth 7, also drawn in dashed lines, to drive the camshaft 1. Aside from the rocker arm 3, rocker arms 8 and 9 for the inlet and exhaust valves, respectively, are also operated by the same cam 2 of the camshaft 1. At its camshaft end, the rocker arm 3 has a counter-cam 10 for operating the injection pump 4. A compression spring 11 is braced against the counter-cam 10 at the rocker arm 3. The compression spring 11 causes the counter-cam 10 to maintain constant contact with the cam 2 of the camshaft 1. Accordingly, the rocker arm 3 pivots about its engine-fast axis of rotation 12. The extension of the rocker arm 3 beyond the axis of rotation 12 is the pump-side end of the rocker arm which ends in a forked part 13 (see FIG. 2) at which an auxiliary roller 15 is mounted. The roller 15 has an outer roller 16 and an inner roller 17 so that it can rotate about a crossbolt 14. The lower end of the piston 19 of the pump is supported by means of broadened foot 18 on the auxiliary roller 15. The foot 18 is held with a small clearance of between 0.05 and 0.1 mm between the auxiliary roller 15 and a catch 20, which is also mounted so that it can pivot about the transverse axis 14 and a baffle sheet 21 disposed on the upper side of the piston foot 18.

The piston 19 of the pump is guided linearly in a surrounding pump cylinder 22 having a borehole 23 for supplying fuel and a borehole 24 for a fuel return line. At the upper end of the piston 19 of the pump, as viewed in FIG. 1, the usual control curves 25 are provided, which are adjusted by a controller 26, shown in greater detail in the plan view of FIG. 2. Depending on the operating point of the engine, the piston 19 of the pump is pivoted about its longitudinal axis in the direction indicated by the double arrow 27 by means of a controller 26. The pivoting is accomplished by means of a push rod 28. An adjusting bolt 30 is accommodated between guide disks 29 and is attached to a swiveling member 31, member 31 is fixedly mounted on the piston 19. As the push rod is moved forward or backward (FIG. 2), the guide disks 29 move the adjusting bolt 30 forward or backward. This pivots the piston 18 in the desired direction as indicated by the arrows 27.

The pump cylinder 22 is formed in the upper part as valve support with the valve 32, 33 and is seated in a borehole 34 of a pipe connection 35, which contains the fuel pressure line 36.

The baffle sheet 21 of the catch 20 has openings 37 on one side, through which the piston foot 18 can be threaded, before the baffle sheet 21 is swiveled in the direction of the arrow 38 over the foot 18 into the indicated end position.

Figure 3:
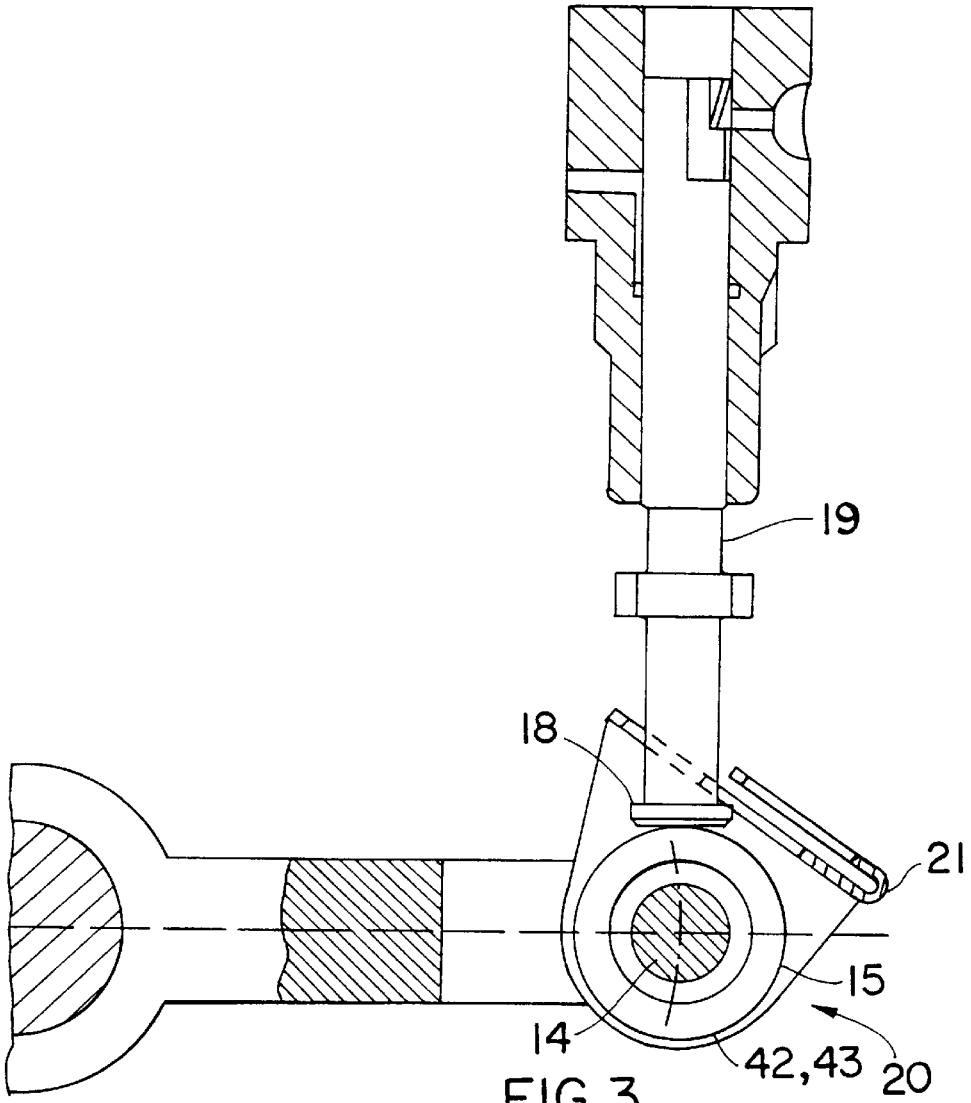
FIG. 3 is a perspective view of the catch.
Figure 4:
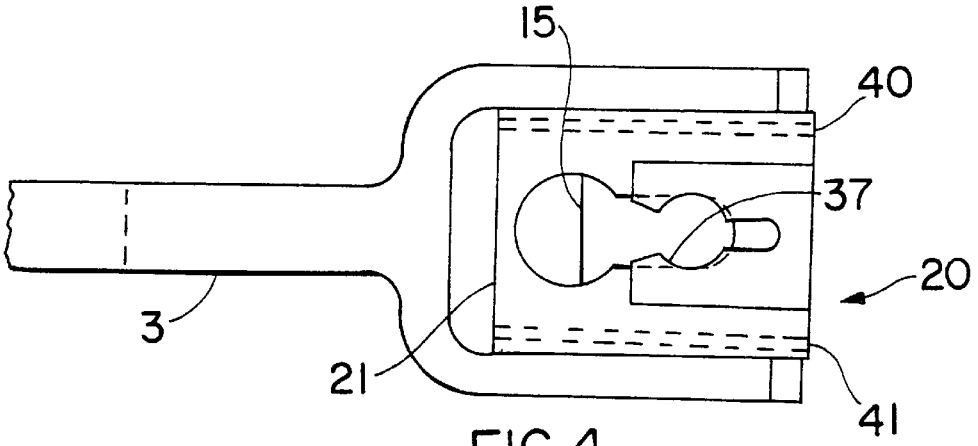
FIG. 4 is a top view of the catch.

Referring now to FIGS. 3 and 4, the catch 20 is made from a formed and punched metal sheet that comprises two side walls 40, 41 having bores 42, 43 respectively, being coaxially arranged with the transverse axis 14. Both side walls 40, 41 are connected via the baffle sheet 21 having openings 37 through which the piston foot 18 of a piston 19 (shown in dotted lines) can be threaded. The catch 20 is pivotally supported by the roller 15 which goes through holes 42, 43. Thus, no additional connecting rod is needed to connect catch 20 to rocker arm 3.

We claim:

1. An injection pump for a diesel engine having a rotatable camshaft, said pump having a pump cylinder with a pump piston slideably mounted therein, said piston having a broadened foot portion of a desired linear dimension, a cam fixedly mounted on said camshaft to rotate when said camshaft rotates, a rocket arm mounted on a pivoting axis and having a camshaft end and a pump-side end, means for holding said camshaft end of said rocker arm in substantial contact with said cam so that said camshaft end of said rocker arm cooperates with said cam as said cam is rotated by said camshaft to pivot said rocker arm about said pivot axis, said pump-side end of said rocker arm having contact means for contacting and moving said piston in said cylinder as said rocket arm is pivoted, said contact means including means for loosely coupling said pump-side end of said rocker arm to said foot portion of said piston, said contact means also including an auxiliary roller and a catch.

2. An injection pump as claimed in claim 1 wherein said means for holding said camshaft end of said rocker arm in contact with said cam is a compression spring.

3. An injection pump as claimed in claim 1 wherein said foot portion of said piston is substantially planar and contacts said auxiliary roller.

4. An injection pump as claimed in claim 3 wherein the axial dimension of said roller is substantially equal to said linear dimension of said foot portion of said piston.

5. An injection pump as claimed in claim 1, wherein said auxiliary roller comprises an outer roller and an inner roller which are tightly fitted into one another coaxially.

6. An injection pump as claimed in claim 1, wherein said catch is fastened to said pump-side end of said rocker arm and grips behind said broadened foot portion of said piston with a baffle sheet.

7. An injection pump as claimed in claim 6, wherein said foot portion of said piston is accommodated with little clearance between said baffle sheet and said auxiliary roller.

8. An injection pump as claimed in claim 1, wherein said catch is pivotally mounted in said rocker arm coaxially with said auxiliary roller.

* * * * *

UNITED STATES PATENT AND TRADEMARK OFFICE

CERTIFICATE OF CORRECTION

PATENT NO. : 5,957,673

DATED : SEPTEMBER 28, 1999

INVENTOR(S) : Gunter KAMPICHLER, et al.

It is certified that error appears in the above-indentified patent and that said Letters Patent is hereby corrected as shown below:

On the title page, Item [63] Related U.S. Application Data, delete "October 3, 1994" and insert--March 10, 1994--.

On the title page, item: [30] Foreign Application Priority Data should be deleted.

Signed and Sealed this

Thirteenth Day of June, 2000

*Attest:*

*Attesting Officer*

Q. TODD DICKINSON

*Director of Patents and Trademarks*